US006199808B1

(12) United States Patent
Lin

(10) Patent No.: US 6,199,808 B1
(45) Date of Patent: Mar. 13, 2001

(54) FITTING ADAPTED FOR HOLDING A SUPPORT MEMBER ON AN UPRIGHT WALL IN SPACED-APART ARRANGEMENT

(76) Inventor: Hsiang-Chuan Lin, No. 160, Shen-Chou Rd., Shan-Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/422,337

(22) Filed: Oct. 21, 1999

(51) Int. Cl.[7] ..... E04G 5/06

(52) U.S. Cl. ..... 248/222.14; 211/105; 248/201; 248/251

(58) Field of Search ..... 248/251, 201, 248/231.91, 222.14, 224.7; 211/105

(56) References Cited

U.S. PATENT DOCUMENTS

| | | | | |
|---|---|---|---|---|
| 5,799,804 | * | 9/1998 | Sharpe | 211/105.1 |
| 5,875,903 | * | 3/1999 | Chen | 211/105.1 |
| 6,012,692 | * | 1/2000 | Meck | 248/251 |
| 6,113,045 | * | 9/2000 | Kuo | 248/222.14 |

* cited by examiner

*Primary Examiner*—Ramon O. Ramirez
(74) *Attorney, Agent, or Firm*—Foley & Lardner

(57) ABSTRACT

A fitting includes a positioning plate with a major mounting wall for fixing on an upright wall, and an annular anchoring wall. A faceplate includes a first major wall defining a bore, and an annular anchored wall surrounding and shielding the annular anchoring wall, and secured to the annular anchoring wall in a radial direction. A first cover member includes a first orientation wall defining a through hole larger than the bore, and a first skirt portion abutting against the faceplate. Apad member is made of a deformable material, and includes a second orientation wall defining an opening smaller than the through hole, a second skirt portion abutting against the first skirt portion, and a tubular portion integrally formed with the rear orientation surface and inserted into the through hole. The tubular portion defines an inner axial through hole communicating with the opening. A second cover member includes a third orientation wall for holding a support member in spaced-apart arrangement from the upright wall, and a third skirt portion abutting against the second skirt portion.

5 Claims, 6 Drawing Sheets

FITTING ADAPTED FOR HOLDING A SUPPORT MEMBER ON AN UPRIGHT WALL IN SPACED-APART ARRANGEMENT

BACKGROUND OF THE INVENTION

1. Field of the Invention

This invention relates to a fitting, more particularly to a fitting adapted for holding a support member, such as a transverse rod or a holding ring, on an upright wall in spaced-apart arrangement.

2. Description of the Related Art

Referring to FIG. 1, a conventional fitting 10 is shown to include a disc-shaped faceplate 11, a positioning plate 12, and a holding member 13. The positioning plate 12 is mounted fixedly on an upright wall (not shown) by fastening members 16. The holding member 13 has an axial screw hole 131 and a holding portion with a holding hole 132 for holding a support member (not shown). A screw 15 passes through a central hole 115 in the faceplate 11 and is inserted threadedly into the screw hole 131 to fasten the holding member 13 on an outer major surface of the faceplate 11 such that the holding member 13 extends transversely from the outer major surface. The faceplate 11 has an engaging seat 111 with an inner wall 113 for engaging an engaging plate portion 121 of the positioning plate 12. The faceplate 11 is fastened to the positioning plate 12 by a fastening screw 14 which extends through a peripheral wall 114 of the faceplate 11 so as to anchor on an anchoring portion 122 of the positioning plate 12.

However, only the screw 15 is used to engage the holding member 13 with the faceplate 11, thereby resulting in unsteady engagement and possible swaying of the holding member 13. In addition, there is no waterproof structure between the connecting portion 131 and the faceplate 11, thereby resulting in rusting of the screws 14,15,16. Moreover, at least two screws 16 are needed to fix the positioning plate 12 on the upright wall.

SUMMARY OF THE INVENTION

The object of the present invention is to provide a fitting which can ensure firm engagement between a second cover member for holding a support member and a positioning plate, and which can be adequately protected from moisture.

According to this invention, the fitting includes a positioning plate which includes a major mounting wall adapted to be fixed on an upright wall, and an annular anchoring wall extending forwardly from a periphery of the major mounting wall. A faceplate includes a first major wall with front and rear major surfaces opposite to each other in a first axial direction and defining a bore with a first dimension, and an annular anchored wall extending rearwardly from a periphery of the first major wall. The annular anchored wall surrounds and shields the annular anchoring wall to keep it out of sight externally, and is secured to the annular anchoring wall in a radial direction. A first cover member includes a first orientation wall with first front and rear orientation surfaces opposite to each other in a second axial direction, and a first skirt portion extending downwardly from a periphery of the first orientation wall. The first skirt portion has a first proximate annular section relative to the first orientation wall, and a first distal annular section which is brought to abut against the faceplate. The first orientation wall includes a first inner annular portion defining a through hole with a second dimension larger than the first dimension of the bore. A pad member is made of a deformable material, and includes a second orientation wall with second front and rear orientation surfaces opposite to each other in a third axial direction. A second skirt portion extends downwardly from a periphery of the second orientation wall and has a second proximate annular section relative to the second orientation wall, and a second distal annular section that is brought to abut against the first skirt portion when the fitting is in an assembled state. The second orientation wall defines an opening with a third dimension smaller than the second dimension of the through hole. The pad member further includes a tubular portion which has a proximate tubular section integrally formed with the rear orientation surface, and a distal tubular section extending from the proximate tubular section downward and with such an outer circumference as to be insertable into the through hole. The tubular portion defines an inner axial through hole in communication with the opening. A second cover member includes a third orientation wall adapted to hold a support member in spaced-apart arrangement from the upright wall, and a third skirt portion extending downwardly from a periphery of the third orientation wall. The third skirt portion has a third proximate annular section relative to the third orientation wall, and a third distal annular section which is brought to abut against the second distal annular section. The third orientation wall defines a tightening hole oriented to be aligned with the inner axial through hole in the assembled state. A tightening rod is inserted into the bore from the rear major surface, and extends through, and forwardly and outwardly of the through holes so as to threadedly engage the tightening hole to depress the pad member against the first orientation wall in the second axial direction.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
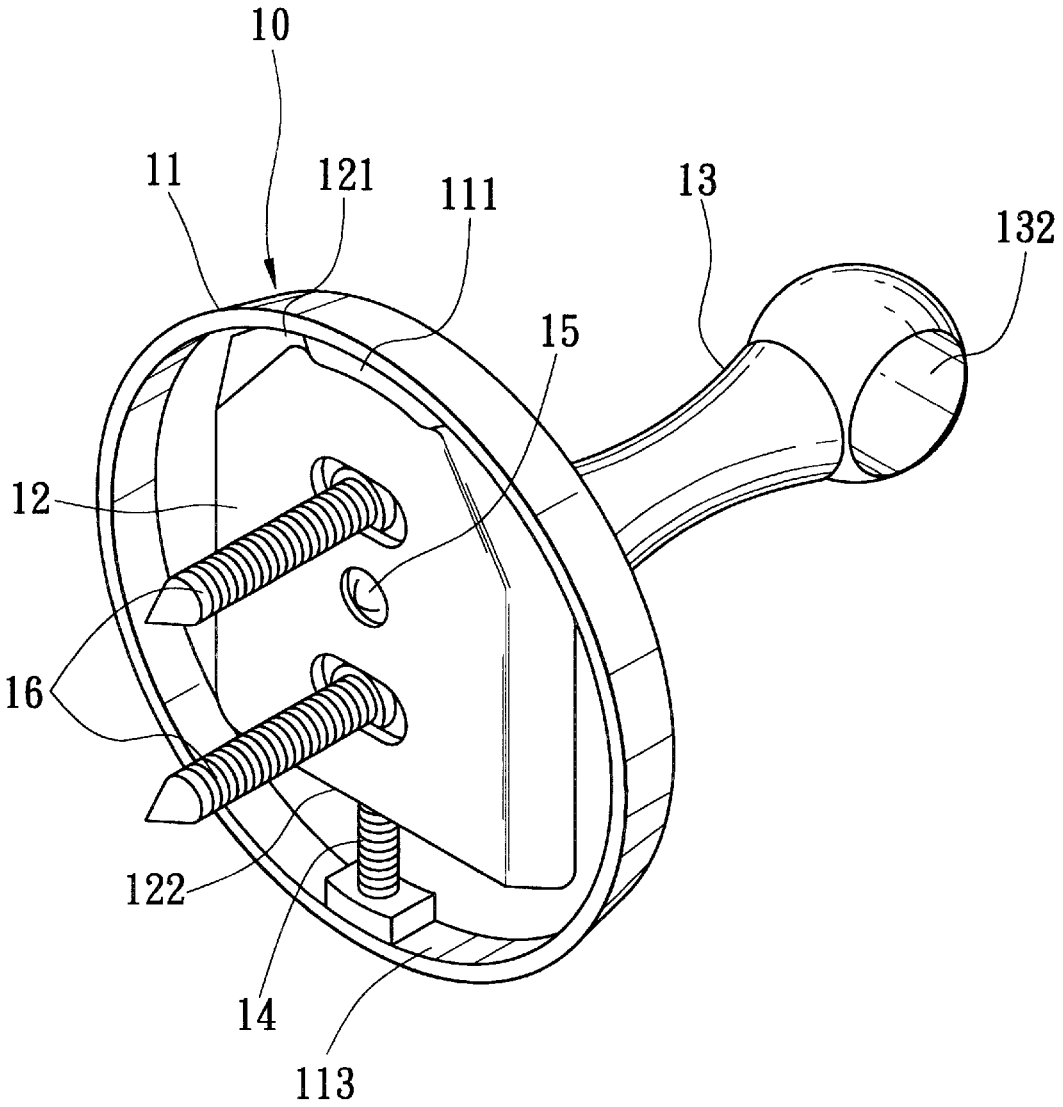
FIG. 1 PRIOR ART
FIG. 1 is a perspective view of a conventional fitting.
Figure 2:
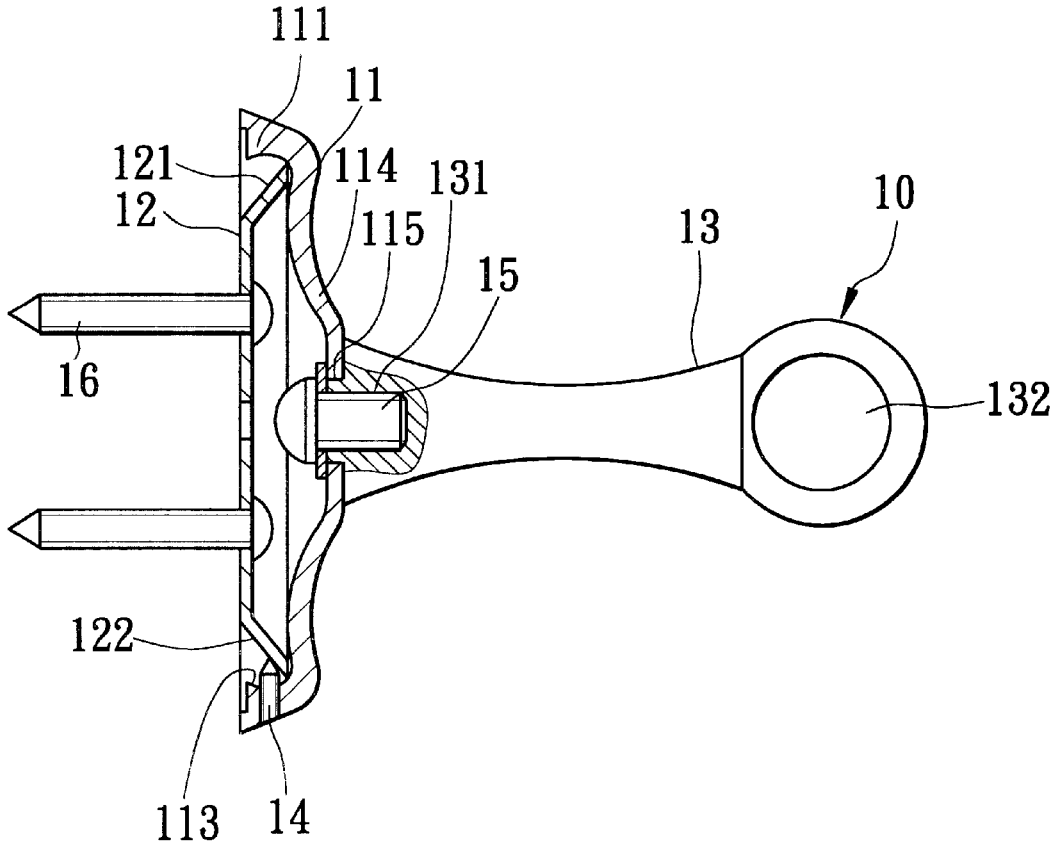
FIG. 2 PRIOR ART
FIG. 2 is a sectional view of the conventional fitting.
Figure 3:
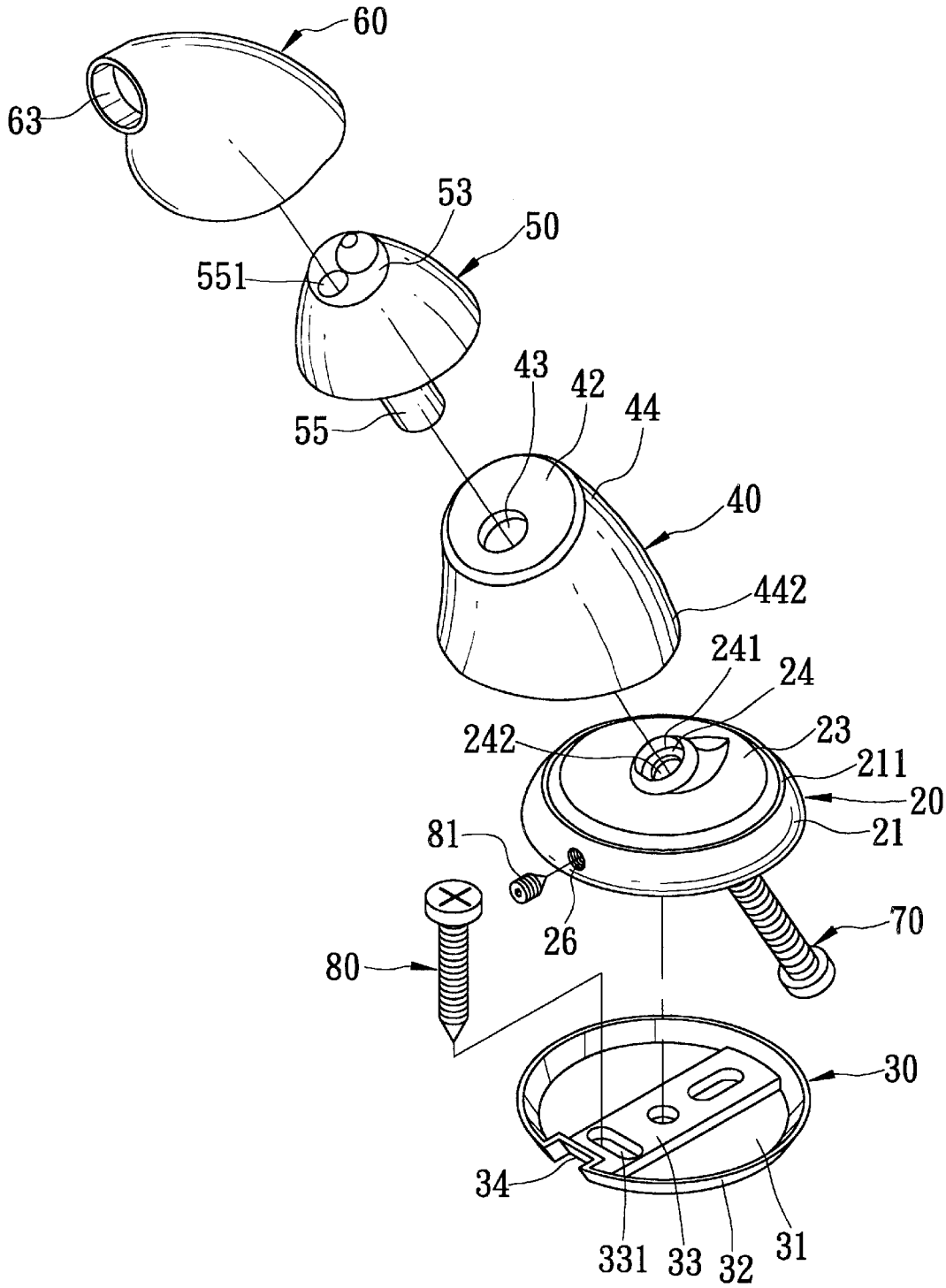
FIG. 3 is an exploded view of a preferred embodiment of a fitting according to this invention.
Figure 4:
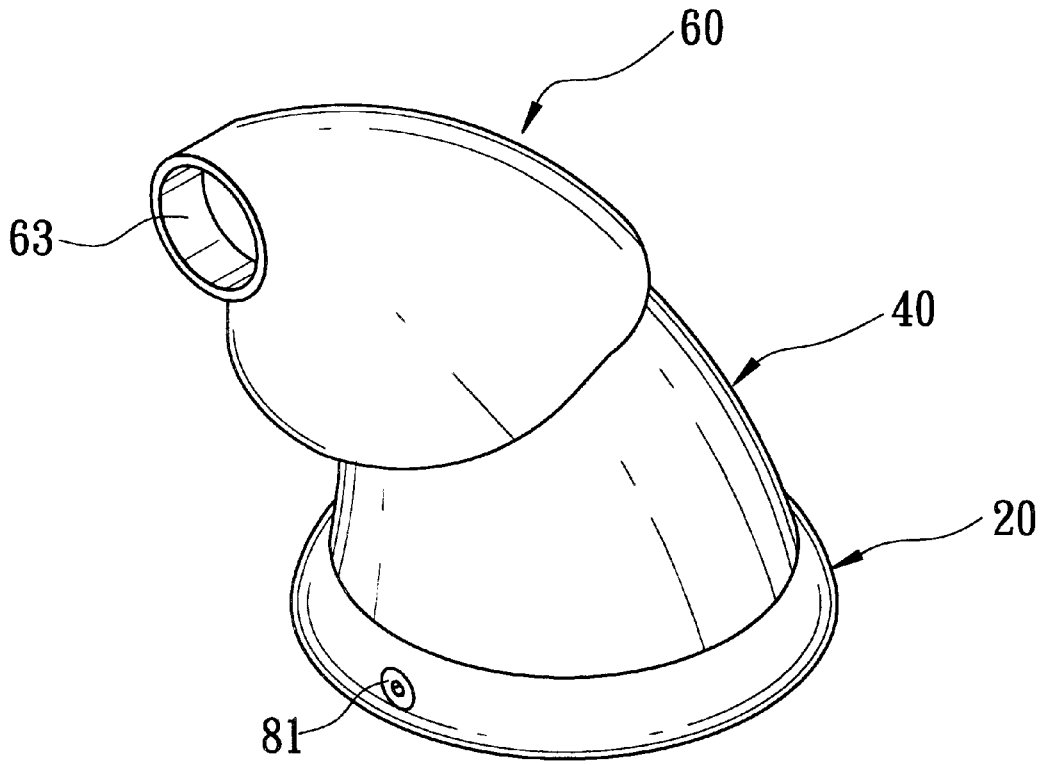
FIG. 4 is a perspective view of the preferred embodiment.
Figure 5:
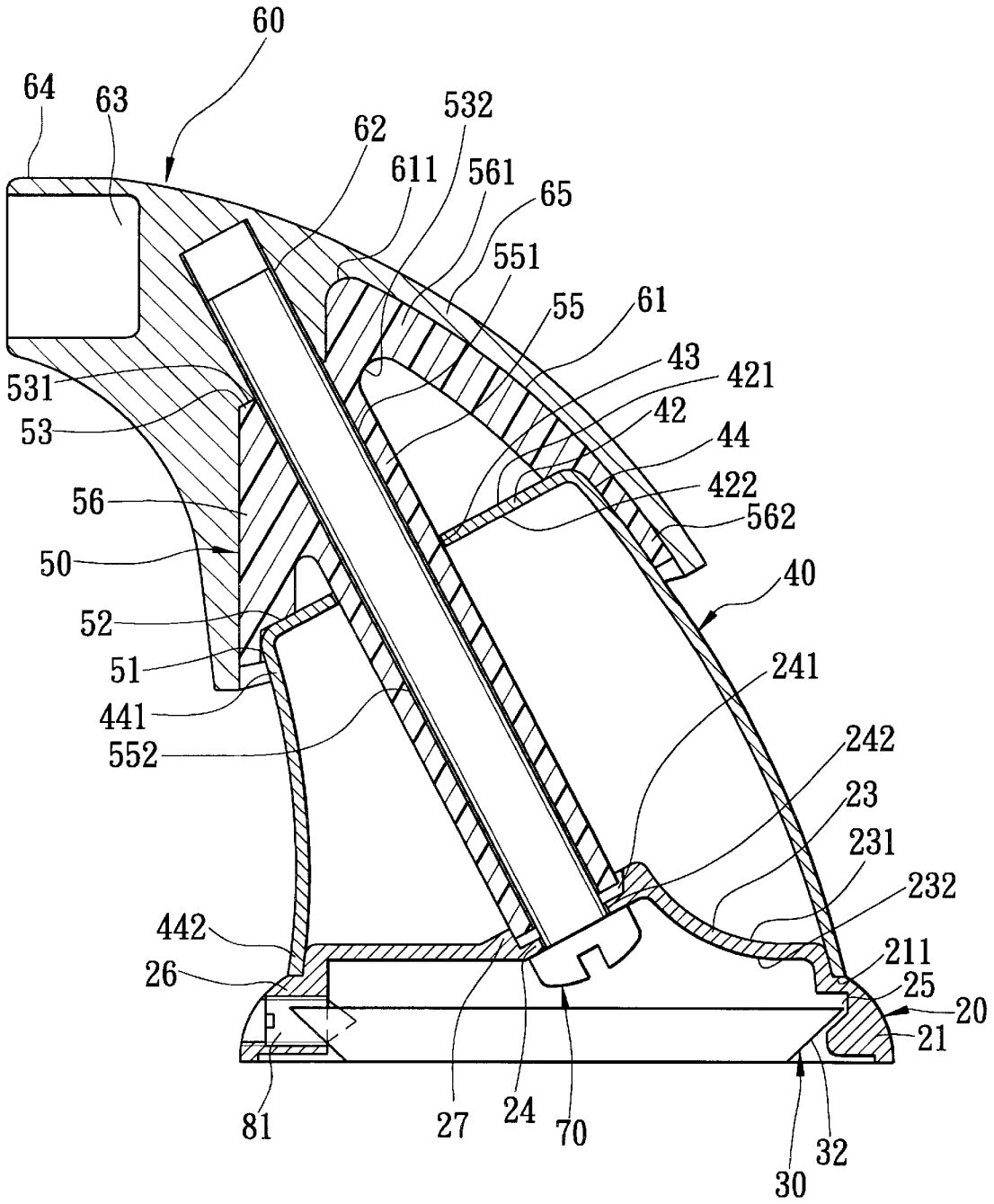
FIG. 5 is a sectional view of the preferred embodiment.

Referring to FIGS. 3, 4 and 5, a preferred embodiment of the fitting according to the present invention is shown to comprise a positioning plate 30, a faceplate 20, a first cover member 40, a pad member 50, a second cover member 60, and a tightening rod 70.

The positioning plate 30 includes a major mounting wall 31 which is provided with a lock plate 33 with lock holes 331 for passage of screw fasteners 80 for fixing on an upright wall (not shown). An annular anchoring wall 32 extends forwardly from a periphery of the major mounting wall 31 and away from the upright wall. The annular anchoring wall 32 is formed with a retaining groove 34 which extends in a radial direction.

The faceplate 20 includes a first major wall 23 which includes front and rear major surfaces 231,232 opposite to each other in a first axial direction. The first major wall 23 has an annular seat portion 24 which defines a bore 242 that has a first dimension and that extends from the front major surface 231 to the rear major surface 232, and an annular boundary portion 27 which extends from the front major surface 231 forwardly and in a second axial direction that is inclined relative to the first axial direction so as to cooperate with the annular seat portion 24 to define an inner annular shoulder portion 241. An annular anchored wall 21 extends rearwardly from a periphery of the first major wall 23, and has an inner peripheral wall which is formed with an annular retaining recess 25 such that the annular anchored wall 21 surrounds and shields the annular anchoring wall 32 from sight externally. A screw hole 26 is formed through the annular anchored wall 21 in the radial direction such that a screw fastener 81 engages threadedly the screw hole 26 and abuts against the retaining groove 34 in the radial direction to secure the annular anchored wall 21 to the annular anchoring wall 32. In addition, an outer annular shoulder portion 211 is disposed at the juncture of the first major wall 23 and the annular anchored wall 21.

The first cover member 40 includes a first orientation wall 42 which includes first front and rear orientation surfaces 421,422 opposite to each other in the second axial direction, and a first skirt portion 44 which extends downwardly from a periphery of the first orientation wall 42 and which has a first proximate annular section 441 relative to the first orientation wall 42 and a first distal annular section 442 that is brought to abut against the outer annular shoulder portion 211 of the faceplate 20. The first orientation wall 42 includes a first inner annular portion which defines a through hole 43 that extends from the first front orientation surface 421 to the first rear orientation surface 422 and that has a second dimension larger than the first dimension of the bore 242.

The pad member 50 is made of a deformable material, such as rubber and plastic material, and includes a second orientation wall 53 which in turn includes second front and rear orientation surfaces 531,532 opposite to each other in a third axial direction that is parallel to the second axial direction in the assembled state, and a second skirt portion 56 which extends downwardly from a periphery of the second orientation wall 53 and which has a second proximate annular section 561 relative to the second orientation wall 53 and a second distal annular section 562. The second distal annular section 562 is formed with an annular retaining groove 51 and an abutting surface 52 so as to be brought to abut against the first orientation wall 42 and the first proximate annular section 441 of the first skirt portion 44 when the fitting is in an assembled state. The second orientation wall 53 defines an opening 551 with a third dimension which is smaller than the second dimension of the through hole 43. A tubular portion 55 includes a proximate tubular section which is integrally formed with the rear orientation surface 532, and a distal tubular section which extends from the proximate tubular section downward and with such an outer circumference as to be insertable into the through hole 43. The tubular portion 55 defines an inner axial through hole 552 which extends from the proximate tubular section to the distal tubular section and which is in communication with the opening 551.

The second cover member 60 includes a third orientation wall 64 with a holding hole 63 extending parallel to the upright wall, and a third skirt portion 65 which extends downwardly from a periphery of the third orientation wall 64 and which has a third proximate annular section relative to the third orientation wall 64 and a third distal annular section 61 that is brought to abut against the second distal annular section of the pad member 50 such that the second orientation wall 53 is surrounded by a recess 611 thereof. The third orientation wall 64 defines a tightening hole 62, such as a screw hole, which is oriented to be aligned with the inner axial through hole 552 in the assembled state.

The tightening rod 70, such as a screw bolt, is disposed to be insertable into the bore 241 from the rear major surface 232, and extends through, and forwardly and outwardly of the through holes 552,551 in threaded engagement with the tightening hole 62, thereby depressing the pad member 50 against the first orientation wall 42 in the second axial direction.

Figure 6:
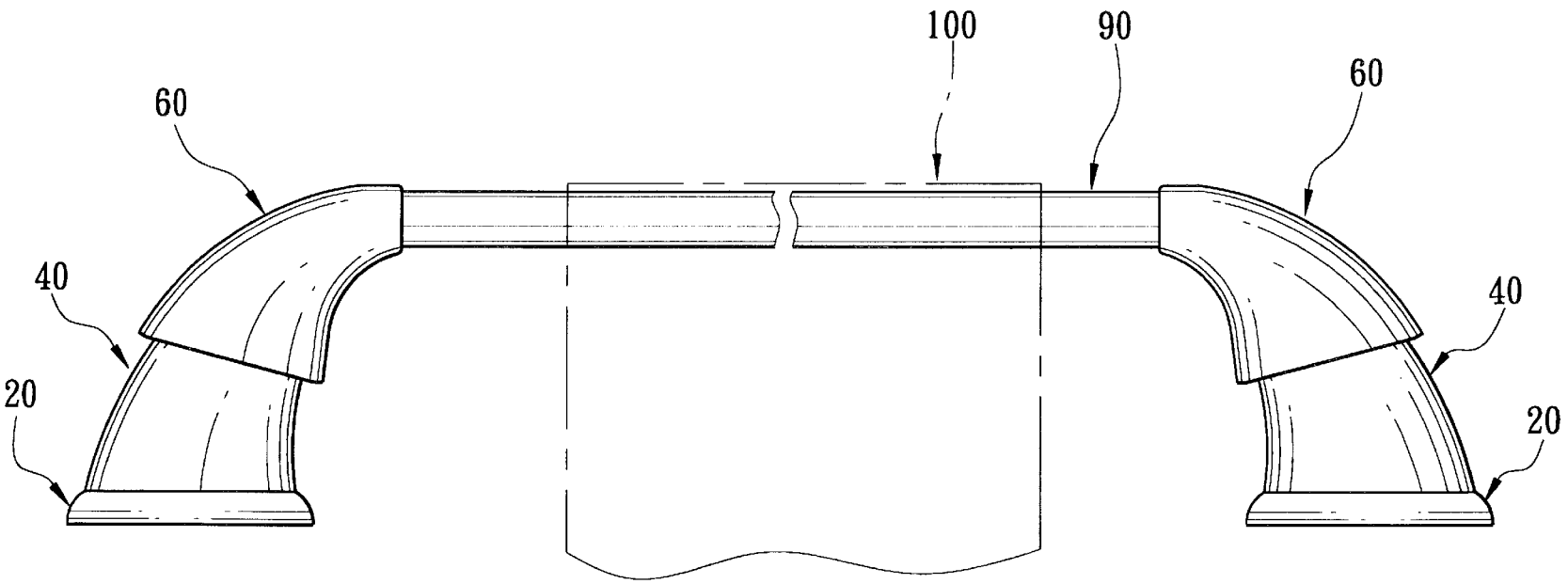
FIG. 6 illustrates the use of the preferred embodiment of this invention for holding a support member in the form of a transverse rod such that the assembly serves as a washcloth rack.

Referring to FIG. 6, when two fittings of this invention are mounted on an upright wall, two ends of a support member in the form of a transverse rod 90 can be held within the holding holes 63 such that a washcloth 100 can be hung over the transverse rod 90.

As illustrated, since the pad member 50 is disposed between the first and second cover members 40,60, and the assembly of the pad member 50 and the cover members 40,60 is secured tightly to the faceplate 20 by the tightening rod 70, the second cover member 60 can be secured to the faceplate 20 very firmly without wobbling during use. In addition, the pad member 50 can engage sealingly the cover members 40,60, thereby protecting the tightening rod 70 from moisture.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A fitting adapted for holding a support member on an upright wall in spaced-apart arrangement, comprising:

a positioning plate including a major mounting wall which has a periphery and which is adapted to be fixed on the upright wall, and an annular anchoring wall which extends forwardly from said periphery and away from the upright wall;

a faceplate including a first major wall with a periphery and which includes front and rear major surfaces opposite to each other in a first axial direction and which defines a bore with a first dimension that extends from said front major surface to said rear major surface, and an annular anchored wall which extends rearwardly from said periphery of said first major wall such that said annular anchored wall surrounds and shields said annular anchoring wall from sight externally, and is secured to said annular anchoring wall in a radial direction;

a first cover member including a first orientation wall with a periphery and which includes first front and rear orientation surfaces opposite to each other in a second axial direction, and a first skirt portion which extends downwardly from said periphery of said first orientation wall and which has a first proximate annular section relative to said first orientation wall and a first distal annular section that is brought to abut against said faceplate, said first orientation wall including a first inner annular portion which defines a through hole extending from said first front orientation surface to said first rear orientation surface and with a second dimension larger than said first dimension of said bore;

a pad member made of a deformable material, and including a second orientation wall with a periphery and which includes second front and rear orientation surfaces opposite to each other in a third axial direction, and a second skirt portion which extends downwardly from said periphery of said second orientation wall and which has a second proximate annular section relative to said second orientation wall and a second distal annular section that is brought to abut against said first skirt portion when said fitting is in an assembled state, said second orientation wall defining an opening with a third dimension which is smaller than said second dimension of said through hole, said pad member further including a tubular portion which includes a proximate tubular section integrally formed with said rear orientation surface, and a distal tubular section extending from said proximate tubular section downward and with such an outer circumference as to be insertable into said through hole in the assembled state, said tubular portion defining an inner axial through hole which extends from said proximate tubular section to said distal tubular section and which is in communication with said opening;

a second cover member including a third orientation wall with a periphery and adapted to hold the support member in spaced-apart arrangement from the upright wall, and a third skirt portion extending downwardly from said periphery of said third orientation wall and having a third proximate annular section relative to said third orientation wall and a third distal annular section which is brought to abut against said second distal annular section in the assembled state, said third orientation wall defining a tightening hole oriented to be aligned with said inner axial through hole in the assembled state; and a tightening rod insertable into said bore from said rear major surface, and extending through, and forwardly and outwardly of said through holes into threaded engagement with said tightening hole to thereby depress said pad member against said first orientation wall in the second axial direction in the assembled state.

2. The fitting as claimed in claim 1, wherein the first axial direction is inclined relative to the second axial direction.

3. The fitting as claimed in claim 2, wherein said first major wall has an annular seat portion disposed in a plane perpendicular to the second axial direction and defining said bore which extends in the second axial direction.

4. The fitting as claimed in claim 3, wherein said first major wall further has an annular boundary portion extending forwardly and in the second axial direction from said front major surface and cooperating with said annular seat portion to define an inner annular shoulder portion of a dimension similar to said second dimension of said through hole for insertion of said distal tubular section.

5. The fitting as claimed in claim 1, wherein said faceplate further has an outer annular shoulder portion disposed at the juncture of said first major wall and said annular anchored wall for abutment of said first distal annular section thereon.

* * * * *